United States Patent [19]

Padula

[11] Patent Number: 4,949,635

[45] Date of Patent: Aug. 21, 1990

[54] TEXTILE PRINTING APPARATUS

[75] Inventor: Benito Padula, Richmond Hill, Canada

[73] Assignee: Benmar Manufacturing Incorporated, Concord, Canada

[21] Appl. No.: 394,946

[22] Filed: Aug. 17, 1989

[51] Int. Cl.[5] ..... B41F 15/10

[52] U.S. Cl. ..... 101/115; 101/128.1

[58] Field of Search ..... 101/127.1, 128.1, 115, 101/126

[56] References Cited

U.S. PATENT DOCUMENTS

| | | | |
|---|---|---|---|
| 2,796,831 | 6/1957 | Heestand | 101/127.1 X |
| 3,427,964 | 2/1969 | Vasilantone | 101/115 |
| 4,669,378 | 6/1987 | Lee | 101/115 |

FOREIGN PATENT DOCUMENTS

| | | | |
|---|---|---|---|
| 3017139 | 11/1981 | Fed. Rep. of Germany | 101/127.1 |

OTHER PUBLICATIONS

Atlas Silk Screen Supply Co., advertisement, p. 61 of *Screen Printing,* May 1977.

Antec advertising brochure, 12 pages, PTO date stamped 06/21/1985.

*Primary Examiner*—Clifford D. Crowder

*Attorney, Agent, or Firm*—Ridout & Maybee

[57] ABSTRACT

A textile printing apparatus for multicolor printing has a plurality of upper and lower arms radiating from a central hub and axle and which are rotatable with respect to one another. The lower arms have platforms for receiving textile workpieces, and the upper arms have clamping means for holding a stencil on top of a workpiece. The upper arms may be raised and lowered to facilitate sequential printing of colors onto a workpiece. Adjustment means are provided for the upper arms so that precise alignment of the stencils can be readily achieved when setting up the apparatus.

12 Claims, 5 Drawing Sheets

TEXTILE PRINTING APPARATUS

The invention relates to improvements in a textile printing apparatus such as the type used for silkscreening designs or patterns onto a textile fabric.

It is frequently desirable to be able to print a textile with more than one color. Multicolor printing requires the sequential application of colors to a textile workpiece using a separate stencil for each color. The principal problem the printer faces when attempting a multicolor printing job is the proper sequential alignment of the various stencils to be used on top of the textile workpiece. The present invention provides an apparatus for multicolor textile printing wherein means are provided to ensure correct alignment of sequentially positioned stencils on top of a workpiece, thereby providing a superior finished product as compared to that obtainable with prior devices.

The invention provides rotating means for the workpieces and stencils so that an operator can carry out sequential printing operations on a plurality of different workpieces without moving his location. The invention incorporates a number of features designed to ensure safe and smooth operation of the apparatus.

Accordingly, the invention provides a textile printing apparatus comprising, an axle and a hub about the axle, the hub and axle being rotatable with respect to one another. Ground support means are provided for the axle and hub. A plurality of radial upper and lower arms are attached directly or indirectly to the hub and axle so that an upper arm may rotate into alignment above a lower arm and vice versa. A platform is attached to each lower arm for receiving a textile workpiece.

Each upper arm has attached to it clamping means for releasably engaging a stencil to be positioned on top of a workpiece. Each upper arm is pivotable between a raised and a lowered position, and spring bias means are provided to urge the arm toward the raised position. A guide means is attached to each lower arm for receiving an upper arm, thereby providing rough alignment of a stencil on top of a workpiece when the upper arm is lowered.

A fine adjustment bar is attached at one end to the clamping means and is releasably and adjustably secured along the upper arm. Adjustment means coact with the fine adjustment bar and the clamping means to provide longitudinal and transverse adjustment of the stencil on top of the workpiece. The adjustment means comprise, a first threaded means, preferably a turnbuckle, for longitudinal adjustment, which extends from the clamping means along and to one side of the upper arm to a transverse strut attached to the upper arm; and a second threaded means, preferably a turnbuckle, for transverse adjustment, which extends transversely from the fine adjustment bar to a strut attached to the upper arm.

Details of preferred adjustment means for the upper arm are shown.

Figure 5:
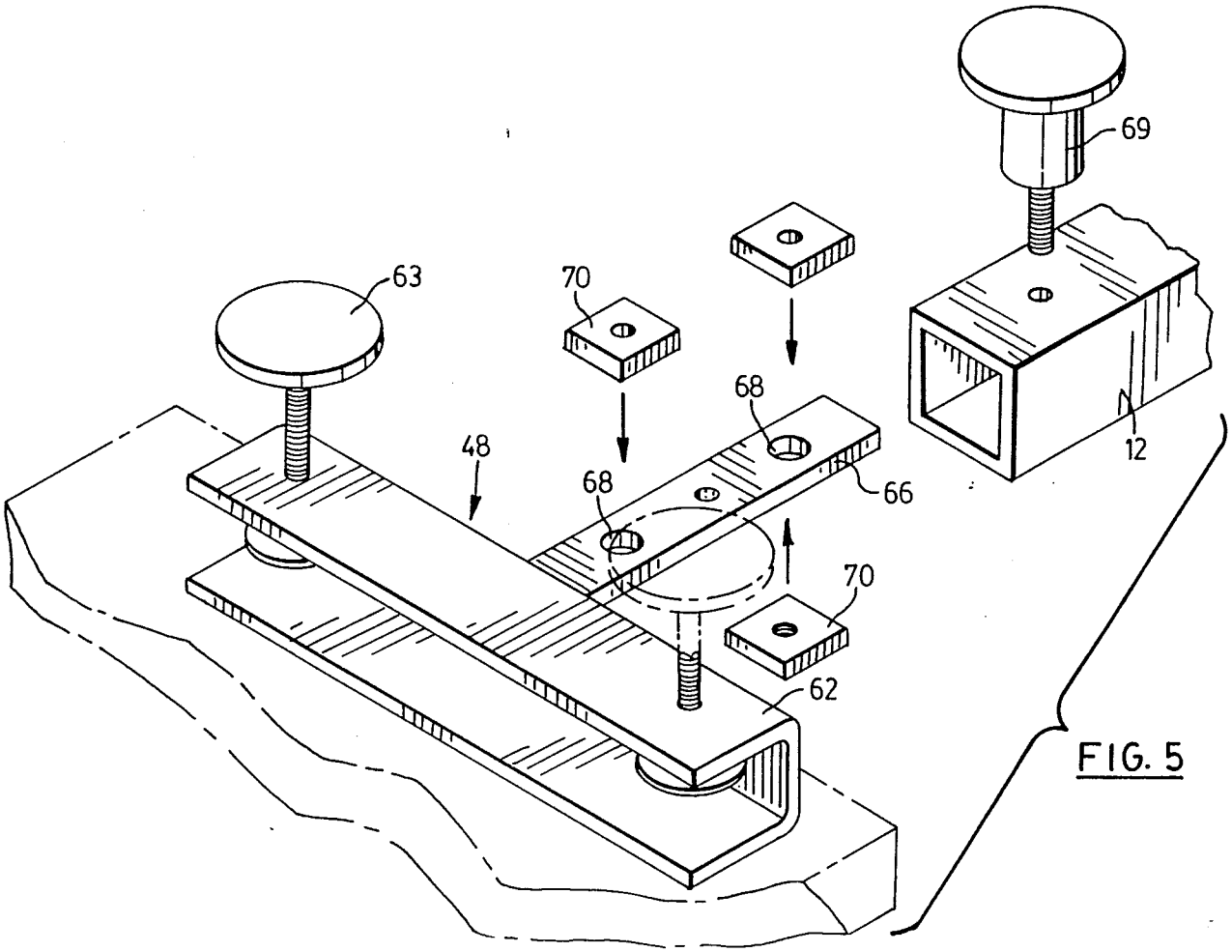

FIG. 5 is an exploded perspective view showing details of a preferred assembly of several upper arm components.

Figure 6:
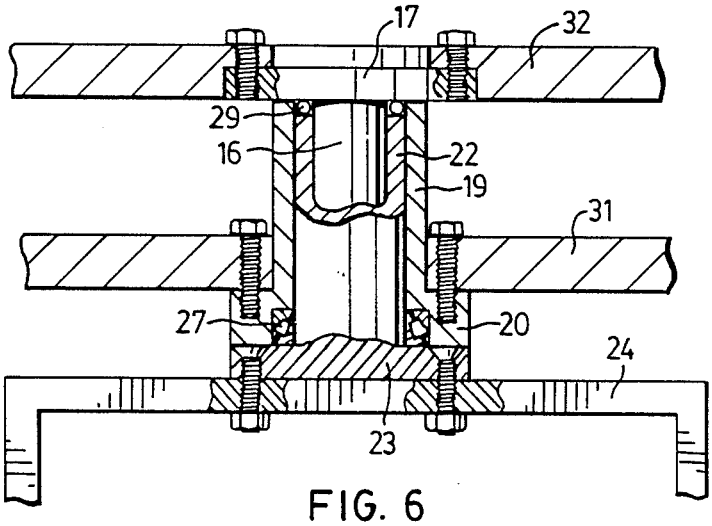

FIG. 6 is a side elevation, partly cut away, showing a preferred arrangement for the axle and hub of the apparatus.

Figure 7:
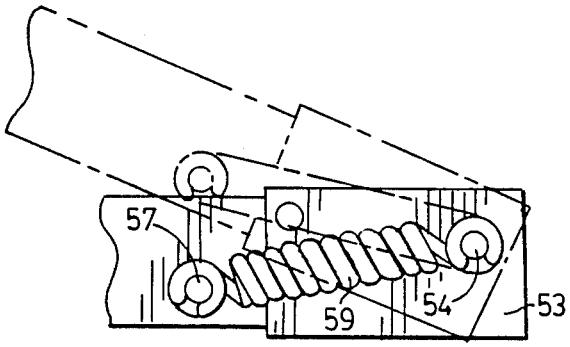

FIG. 7 is a side elevation of a detail of the preferred spring biased pivoting of the upper arm.

Figure 8:
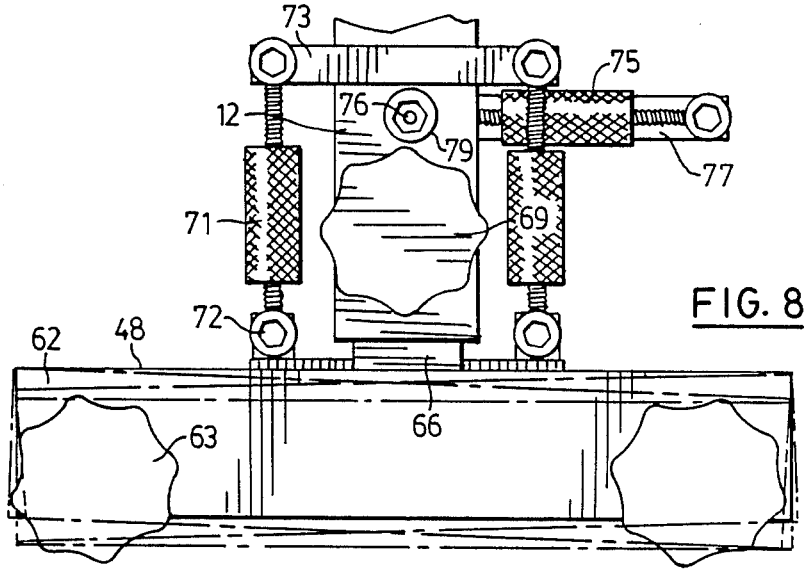

FIG. 8 is an overhead plan view of the adjustable end portion of the upper arm showing the fine adjustment capability for the clamping means provided by a preferred arrangement of the adjustment means.

Figure 1:
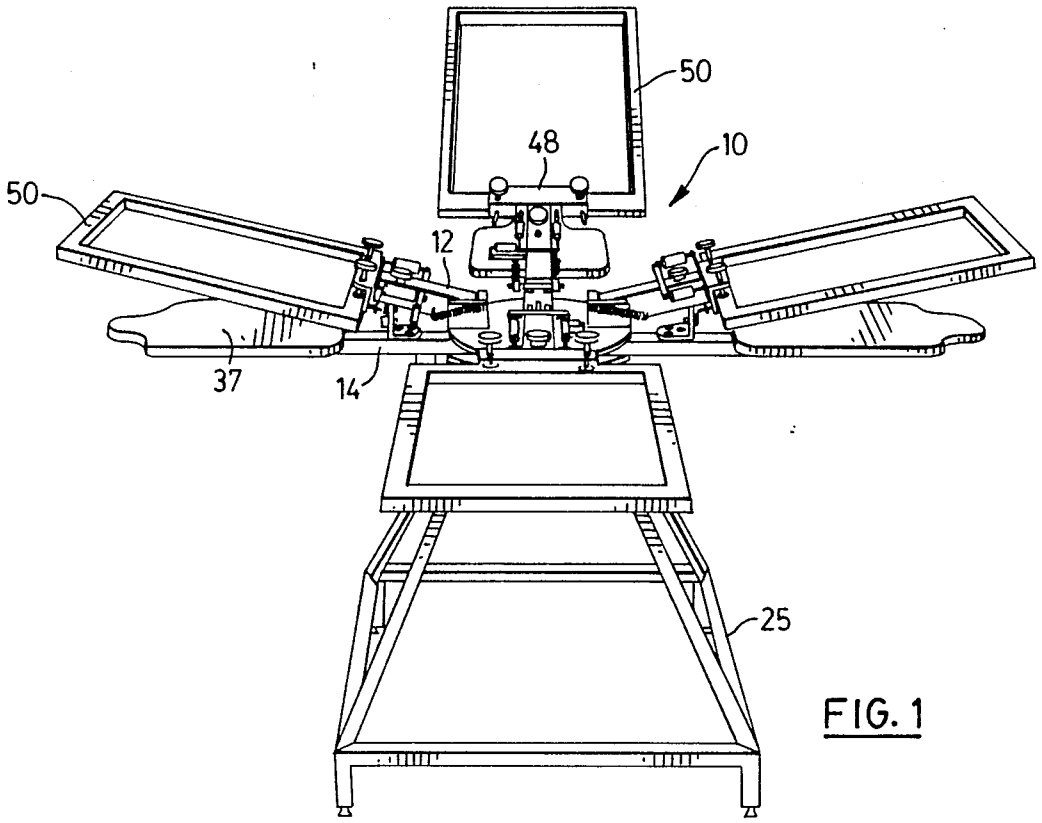
FIG. 1 is a perspective view of a preferred four color printing apparatus of the invention.

An apparatus 10 for printing four colors onto a textile workpiece is shown in FIG. 1. The invention includes devices for printing two or more colors onto a workpiece, and the device illustrated is exemplary of a preferred embodiment. Typically, a device capable of printing six colors is the largest type in commercial demand.

Figure 2:
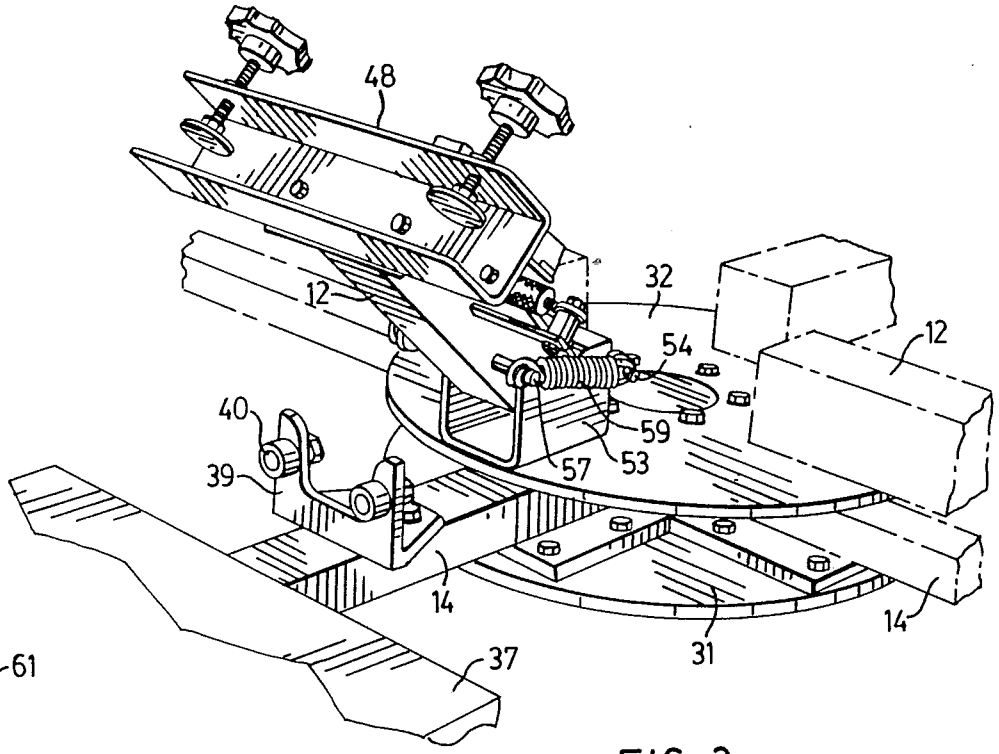
FIG. 2 is a perspective detail view of an upper arm in the raised position over a preferred guide means on a lower arm.

As shown in FIG. 2, the apparatus 10 has a plurality of upper and lower radially extending arms 12 and 14. Each upper arm 12 can be rotated into alignment above a lower arm 14, and each lower arm 14 can be rotated into alignment beneath an upper arm 12. The independent rotational positioning of the upper and lower arms 12 and 14 is provided by means of a central axle and hub arrangement shown in FIG. 6.

In the preferred embodiment, an axle 16 has a flange 17 about its upper end, and a hub 19 having a flange 20 about its lower end fits over the axle 16 and is rotatable about the axle 16. In a more preferred embodiment shown in FIG. 6, a tubular axle 22 has a flange 23 about its lower end. The flange 23 provides a means for attachment of the axle 22 to a ground support 24, preferably the stand 25 shown in FIG. 1. The hub 19 fits over the hollow axle 22 and is rotatably supported by a roller bearing 27 positioned about the axle 22 adjacent the flange 23. The axle 16 is sized to fit within the tubular axle 22 and is rotatably supported atop the tubular axle 22 by a roller bearing 29 positioned about the axle 16 adjacent the flange 17. This arrangement enables the axle 16 to be independently rotatable relative to the hub 19. The flange 20 of the hub 19 provides a means for attachment of a plurality of radially extending lower arms 14 to it, and as shown in FIG. 2, this is preferably accomplished indirectly by attaching a circular support 31 to the flange 20 to which in turn are attached the lower arms 14. Similarly, a plurality of radially extending upper arms 12 are attached to the flange 17 of the axle 16 preferably indirectly by attaching a circular support 32 to the flange 17 to which in turn are attached the upper arms 12.

Each lower arm 14 is equipped with a platform 37 for receiving a textile workpiece for printing. The platforms 37 shown in FIG. 1 are intended for printing T-shirts or the like, and the platforms 37 may be configured in accordance with the workpiece being printed. Each lower arm 14 also has a guide means 39 for receiving a portion of the upper arm 12. The guide means 39 attached to the lower arm 14 provides bottom and lateral support for the upper arm 12 so that it may be positioned in rough alignment with the workpiece being printed. The preferred U-shaped conformation of the guide means 39 shown in FIG. 2 preferably includes resilient rollers 40 which ensure a snug engagement of the upper arm 12 in the guide means 39 (see FIG. 4).

Figure 4:
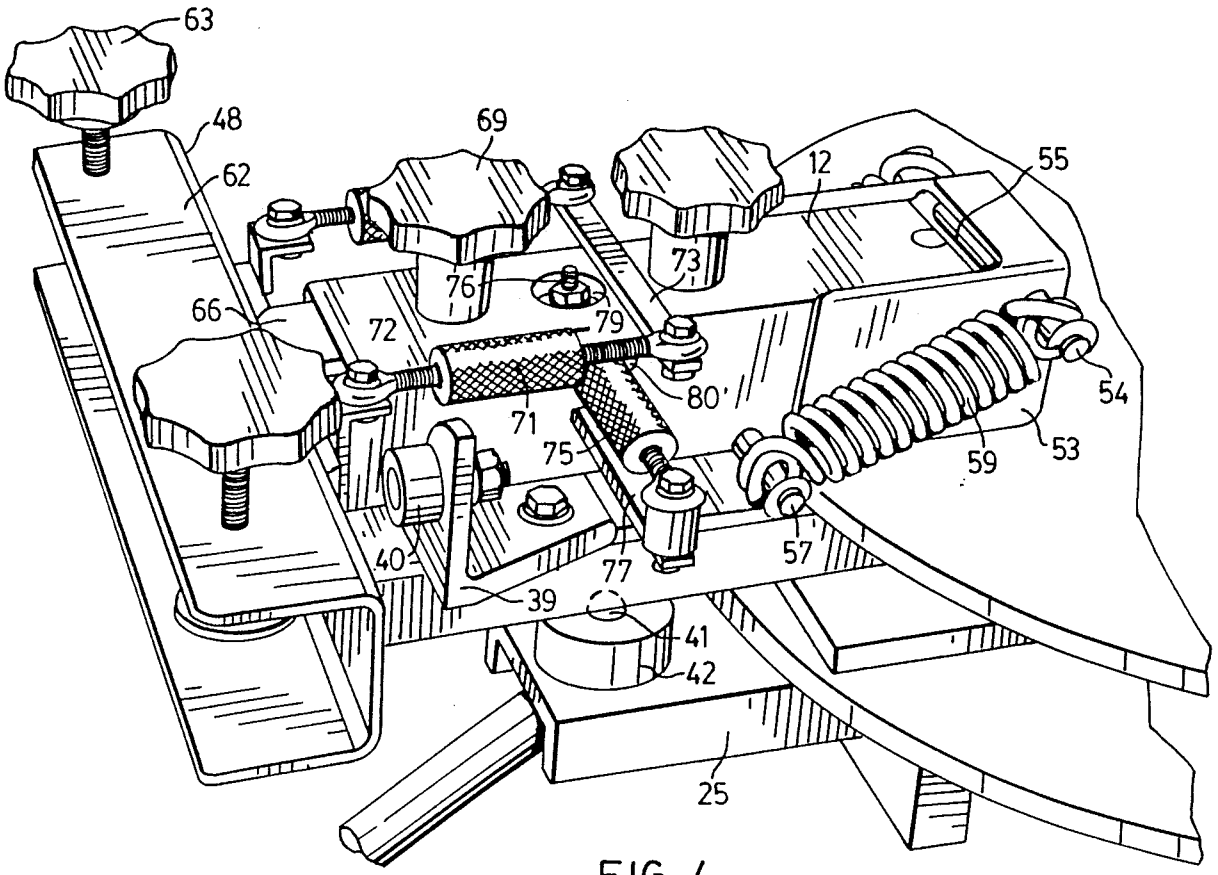
FIG. 4 is a side perspective view of an upper arm lowered onto guide means attached to a lower arm.

Preferably, means are provided for restraining the lower arm 14 from rotation when it is at an operator's work station. As shown in FIG. 4, a preferred restraining means for the lower arm 14 comprises a ball bearing 41 mounted in a socket 42 on the stand 25, which ball bearing 41 coacts with an indentation, slot or groove on the underside of the lower arm 14 to restrain the arm 14 from further rotation. The restraining force of the ball bearing 41 can be overcome by deliberately pushing on the arm 14 or the platform 37 thereby dislodging the arm from the ball bearing 41.

Each upper arm 12 has attached to it a clamp 48 for releasably engaging a stencil 50 (FIG. 1). The upper arm 12 is pivotable from a raised to a lowered position so that the stencil 50 can be lowered onto a workpiece positioned on the platform 37 of a lower arm 14 for a printing operation, and then raised so that it may be rotated to the next work station, or so that another workpiece can be rotated into place beneath it. A preferred pivot structure for the upper arm 12 is shown in FIGS. 2, 4 and 7, wherein a bracket 53 is attached to the circular support 32, and an upper arm 12 is attached to the bracket 53 by a pin 54. Preferably, the pin 54 hinges the upper arm 12 to the bracket 53 at or near the rear top edge 55 of the arm 12. By extending both ends of the pin 54 beyond the sides of the bracket 53 and by providing pins 57 extending symmetrically from near the bottom of either side of the arm 12, a spring 59 can be attached from each end of the pin 54 to a pin 57 to provide a biasing of the upper arm 12 toward the raised position.

Figure 3:
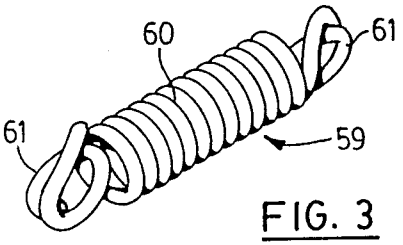
FIG. 3 is a perspective view of a preferred spring used to bias the upper arm.

A preferred spring 59 is shown in detail in FIG. 3. The preferred spring 59 has a coiled body portion 60 with at least double coiled end portions 61. The preferred heavy duty springs 59 used for biasing the upper arm 12 can pose a safety hazard to an operator if such a spring 59 fails under tension. The most likely site of spring failure is about either pin 54 or 57 where metal fatigue may result in breakage of the spring 59 at its end portion. The provision of double coiled end portions 61 for the heavy duty spring 59 greatly reduces the risk of spring failure and potential injury to the operator.

It will be appreciated by the skilled person that the spring biasing of the upper arm 12 is designed to assist the raising and lowering of the upper arm 12, and therefore, should not be so strong as to cause the arm 12 to return to the raised position without the application of manual force from the operator. The spring force should be strong enough to hold the upper arm 12 in the raised position once it is moved there by the operator.

The function of the upper arm 12 is to position a stencil 50, for example, a silkscreen, on top of a textile workpiece, for example, a T-shirt or sweatshirt, so that a design can be printed onto the workpiece. When printing a design which utilizes several colors, those colors must be printed sequentially onto the workpiece. It is essential, in order to achieve a good quality result, to have proper alignment of sequentially applied stencils in relation to the workpiece.

The present invention provides a superior alignment mechanism for a stencil 50 held by an upper arm 12. As shown in FIG. 5, the clamp 48 which holds the stencil 50 is preferably an elongate U-shaped member 62 which opens forwardly to receive the stencil frame 50. Preferably, two screw clamping members 63 are located near either end of the elongate U-shaped member 62 for releasably engaging a stencil 50. The clamp 48 is attached to an upper arm 12 by means of a fine adjustment bar 66 which is attached centrally to the rear face of the U-shaped member 62 and is releasably and adjustably secured along the upper arm 12. As shown in FIG. 5, preferably the upper arm 12 is hollow so that the bar 66 can be inserted into the arm 12 and secured in it. More preferably, the upper arm 12 is a square section tube dimensioned to allow the bar 66 to be releasably and adjustably attached within it by bolt and nut means.

As seen in FIGS. 4 and 5, the fine adjustment bar 66 has an oversized circular hole 68 through it near each end. Bolts 69 are each threaded through a pair of square nuts 70 located on either side of the bar 66 about each hole 68. The nuts 70 are sized to fit within the upper arm 12 so as not to be rotatable. By tightening the bolts 69, the bar 66 and clamp 48 are secured firmly in place along the upper arm 12. By loosening the bolts 69, the position of bar 66 may be adjusted within the limitations afforded by the holes 68 in juxtaposition to the bolts 69 extending through them.

Adjustment means for-the fine adjustment of a stencil 50 held in the clamp 48 on top of a textile workpiece positioned on a platform 37 is provided in association with the fine adjustment bar 66, the clamp 48 and the upper arm 12. A preferred adjustment means is shown in FIGS. 4 and 8 most clearly. In this preferred arrangement, a first threaded means, such as a turnbuckle 71, extends along the upper arm 12 from an attachment point 72 on the U-shaped clamp member 62 to one side of the fine adjustment bar 66 to a strut 73 extending laterally from the upper arm 12. By adjusting the length of the first threaded means 71, the U-shaped clamp member 62 is moved in the longitudinal direction relative to the upper arm 12. Preferably, a second threaded means, such as a turnbuckle 75, extends transversely of the upper arm 12 from an attachment point 76 on the adjustment bar 66 to a strut 77 extending laterally from the arm 12. By adjusting the length of the second threaded means 75, the U-shaped clamp member 62 is moved in the transverse direction relative to the upper arm 12. Clearly, the attachment point 76 on the bar 66 for the turnbuckle 75 must enable movement of the bar 66, so in the preferred arrangement shown in FIGS. 4 and 8, apertures 79 and 80 are provided through the top and side surfaces of the arm 12 to ensure freedom of movement for the bar 66 restricted only by the limitations of the apertures 68 through the bar 66 itself.

In the most preferred arrangement as shown in FIGS. 4 and 8, a pair of turnbuckles 71 are provided along either side of the upper arm 12 from the clamp 48 to the transverse strut 73 extending from the arm 12. This combination of three turnbuckles enables precise alignment of a stencil 50 on top of a workpiece by providing precise fine adjustment of the U-shaped clamp member 62 in the longitudinal and transverse direction (see FIG. 8).

In operation, the various workpieces are secured in place on the platforms 37 of the lower arms 14, and the stencils 50, such as silkscreens, are clamped into the clamps 48 of the upper arms 12. Each stencil 50 is aligned on a workpiece by rotating each upper arm 12 in turn over the platform 37 to which it is affixed. Rough alignment is achieved by lowering the upper arm 12 into the guide means 39 on the lower arm 14 and positioning the stencil 50 on top of the workpiece by loosening the screw clamping members 63. After retightening the screw clamping members 63, the stencil 50 may be precisely aligned in the workpiece by loosening the bolts 69 and manipulating the turnbuckles 71 and 75. When precise alignment is achieved, the bolts 69 are retightened.

While the foregoing description has been directed primarily to the most preferred embodiment presently favoured by the inventor, this description should not be construed as limiting the scope of the invention which is particularly defined in the following claims.

I claim:

1. A textile printing apparatus, comprising:

an axle and a hub about the axle, the hub and axle being rotatable with respect to one another;

ground support means for the axle and hub;

means associated with the hub and axle for attaching a plurality of upper and lower arms extending radially from the hub and axle, an upper arm being capable of rotating into alignment above a lower arm and a lower arm being capable of rotating into alignment beneath an upper arm, said means comprising a first flange attached to the axle and a second flange attached to the hub with first and second circular supports being attached respectively to the first and second flanges, the circular supports providing structures to which the upper and lower arms are attached;

a platform attached to each lower arm for receiving a textile workpiece;

pivot means for each upper arm enabling each upper arm to pivot between a raised and a lowered position, said pivot means comprising a bracket attached to the circular support for the upper arms, each upper arm being a rectangular section tubular member having flat bottom, top and side surfaces and front and rear rectangular edges, each upper arm being attached pivotally to the bracket by a pin so that the upper arm may be moved between a raised and a lowered position, and wherein the pin hinges the upper arm to the bracket near the rear top edge of the upper arm;

clamping means being adjustably attached to each upper arm for releasably engaging a stencil to be positioned on top of a workpiece so that a pattern might be printed thereon;

spring bias means for urging each upper arm toward the raised position;

guide means attached to each lower arm for receiving the upper arm when it is lowered, the guide means providing rough alignment of a stencil on top of a workpiece;

a fine adjustment bar attached to and extending transversely from each clamping means, the bar being releasably and adjustably secured along an upper arm; and adjustment means for exact alignment of a stencil held by a clamping means on top of a textile workpiece, the adjustment means comprising a first threaded means for adjustment of the clamp means in the longitudinal direction of the upper arm, the first threaded means extending from the clamping means along and to one side of the upper arm to a strut extending transversely from the upper arm; and a second threaded means for adjustment of the clamp means in the transverse direction of the upper arm, the second threaded means extending from the fine adjustment bar transversely to a strut attached to the upper arm.

2. An apparatus as claimed in claim 1, further comprising a tubular axle having a flange at its lower end for attaching the axle to ground support means, a first roller bearing positioned about the tubular axle adjacent the axle flange for rotatably supporting the hub about the tubular axle, a cylindrical axle sized to fit rotatably within the tubular axle, the cylindrical axle having a flange at its upper end, and second roller bearing means positioned about the cylindrical axle adjacent the axle flange for rotatably supporting the flange atop the tubular axle.

3. An apparatus as claimed in claim 1, wherein the pin extends outwardly beyond either side of the bracket, spring attachment means are provided near the bottom of either side of the upper arm, and a spring is attached along either side of the upper arm from each pin extension to each spring attachment means so that the upper arm is biased toward the raised position.

4. An apparatus as claimed in claim 3, wherein the spring has a coiled body and either end of the spring has at least a double coil for attachment to the pin and spring attachment means.

5. An apparatus as claimed in claim 1, wherein the clamping means comprises an elongate U-shaped member opening forwardly of the upper arm, the elongate member being adjustably attached transversely of the upper arm; and at least two screw clamping members coacting with the elongate member to clamp a stencil therein.

6. An apparatus as claimed in claim 1, wherein the upper arm is a rectangular section tube and the fine adjustment bar is secured releasably and adjustably within the upper arm.

7. An apparatus as claimed in claim 6, wherein the first and second threaded means for adjustment of the clamp means are turnbuckles, and the second threaded means is attached to the fine adjustment bar through an aperture defined in the side of the upper arm, and an aperture is defined through the top of the upper arm about the point of attachment of the second threaded means to the fine adjustment bar so that adjustment of the bar by the threaded means is not restricted about said point of attachment.

8. An apparatus as claimed in claim 1, wherein the fine adjustment bar is secured along the upper arm by bolt and nut means.

9. An apparatus as claimed in claim 8, wherein the fine adjustment bar has two oversized apertures spaced along its length, and the bar is secured to the upper arm by a bolt passing through each aperture, each bolt coacting with a pair of nuts, one on either side of the aperture.

10. An apparatus as claimed in claim 9, wherein the nuts have flat sides which coact with the sides of the upper arm thereby preventing the nuts from rotating.

11. An apparatus as claimed in claim 1, wherein the first and second threaded means for adjustment of the clamp means are turnbuckles.

12. An apparatus as claimed in claim 1, wherein a pair of first threaded means for adjustment of the clamp means extend along either side of the upper arm.

* * * * *